United States Patent [19]

Morén

[11] Patent Number: 4,752,137

[45] Date of Patent: Jun. 21, 1988

[54] POKER VIBRATOR

[75] Inventor: Jan Morén, Karlskrona, Sweden

[73] Assignee: Dynapac AB, Solna, Sweden

[21] Appl. No.: 925,700

[22] Filed: Oct. 29, 1986

[30] Foreign Application Priority Data

Oct. 30, 1985 [SE] Sweden ..... 8505114-2

[51] Int. Cl.[4] ..... B01F 11/00

[52] U.S. Cl. ..... 366/123; 366/120; 366/128

[58] Field of Search ..... 366/108, 116, 117, 120–123, 366/128; 74/87

[56] References Cited

U.S. PATENT DOCUMENTS 1,988,316 1/1935 Jackson ..... 366/123 X
2,015,217 9/1935 Deniau ..... 366/122 X
2,597,505 5/1952 Lindkvist ..... 366/122 X
3,395,894 8/1968 Hedelin ..... 366/120 X
3,836,124 9/1974 Malan ..... 366/122

*Primary Examiner*—Timothy F. Simone
*Attorney, Agent, or Firm*—Walter Ottesen

[57] ABSTRACT

A poker vibrator includes an extra weight which is mounted on the hose accommodating the power supply of the vibrator of the poker vibrator assembly connected to the end of the hose. The extra weight is mounted on the hose in the vicinity of the casing. The extra weight is also in the area of the hose where it is manually held by the operator when using the poker vibrator. The poker vibrator equipped with the extra weight prevents or at least damps the vibration amplitude and with it the intensity of the vibration in the area of the hose manually held by the operator.

5 Claims, 1 Drawing Sheet

POKER VIBRATOR

FIELD OF THE INVENTION

The invention relates to a handheld poker vibrator having a device for damping vibration and for eliminating the harmful effects of vibration on the operator when using the poker vibrator.

BACKGROUND OF THE INVENTION

Poker vibrators are used for internally vibrating elastic materials such as freshly poured concrete and include an eccentric weight arranged to rotate in a cylindrical casing. The vibration-generating rotational motion of the weight is imparted to the latter either by an external drive unit or by an electric motor incorporated in the poker.

Poker vibrators of the kind referred to above are generally classified as hand tools in which power is transmitted from the power source or drive unit to the eccentric weight arranged inside the cylindrical casing of the poker via an electric cable, a flexible drive shaft or a compressed air hose. For practical reasons connected with the way the poker is used, the sheathing enclosing the cable, drive shaft, et cetera, is relatively stiff, at least that part of it closest to the poker held by the operator is, with the result that a large proportion of the vibration generated in the poker is also transmitted to this part of the sheathing. The propagated vibration is often of such a magnitude that it can harm the operator, particularly over long periods of time.

SUMMARY OF THE INVENTION

It is an object of the invention to provide a poker vibrator wherein the vibration is damped which is transmitted to that part of the poker's power transmission element that is held by the operator when using the poker vibrator.

type of vibrator on which the invention is applied in practice.

The practical application of the invention is primarily of interest in connection with those handheld vibrators in which the vibration frequency and amplitude are of such magnitude that injury to the operator may be caused.

BRIEF DESCRIPTION OF THE DRAWING

The invention will be described with reference to the drawing wherein.

DESCRIPTION OF THE PREFERRED EMBODIMENTS OF THE INVENTION

Figure 1:
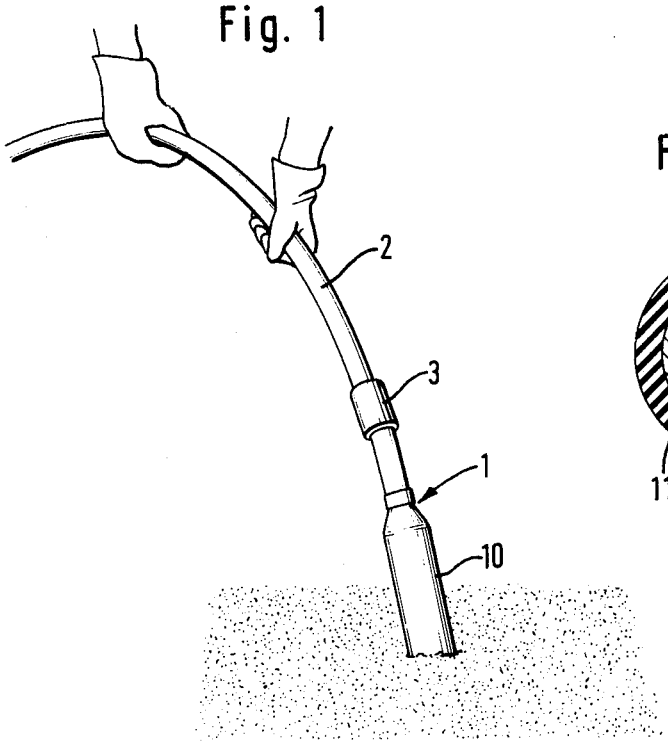
FIG. 1 shows a poker vibrator partially immersed in freshly poured concrete and fitted with an extra weight in accordance with a feature of the invention.

FIG. 1 shows a poker vibrator 1 partially immersed in a substance such as freshly poured concrete. The poker vibrator 1 is supplied with power via a hose 2 of flexible material such as hard rubber in which may be enclosed an electric cable, a flexible drive shaft or a compressed air line, depending on the type of poker vibrator in question.

Figure 2:
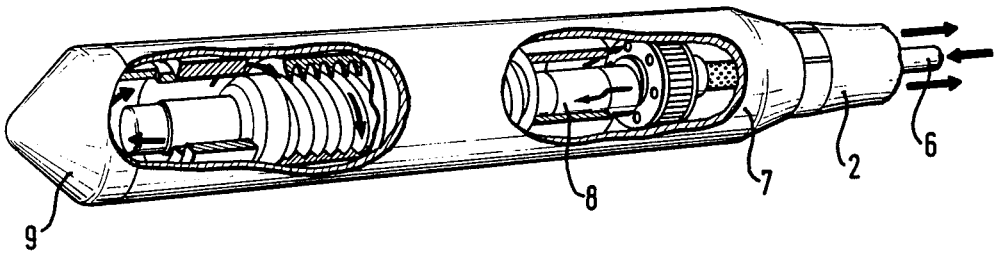
FIG. 2 is a perspective view of the vibrator assembly of a pneumatic poker vibrator with parts of the casing broken away to show the eccentric weight means contained within the latter.
Figure 3:
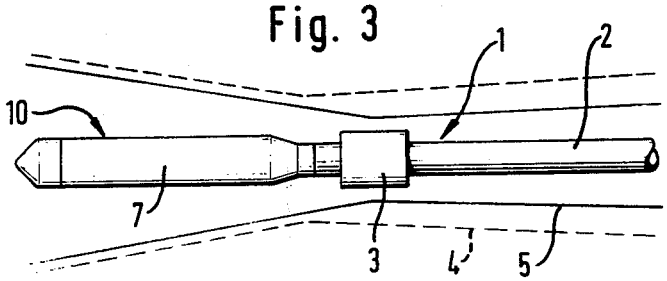
FIG. 3 is a schematic showing the approximate amplitude distribution on a poker vibrator of conventional design as well as on a poker vibrator equipped with an extra weight in accordance with a feature of the invention; and, FIG. 4 is an elevation view, in section, showing another embodiment of the invention wherein the extra weight is mounted inside the hose.

FIG. 2 shows the vibrator assembly of a pneumatic poker vibrator which is exemplary of the type of poker vibrator which can incorporate the damping weight in (c) the flexibility of the hose 2.

All three criteria must be optimal in order to achieve the desired result, which is attainable by means of the invention in a simple and practical manner without reducing the vibrational effect and capacity of the poker vibrator.

The weight 3 should be as large as possible to have the greatest possible damping effect. However, its size must not conflict with the requirement of handling ease.

The weight 3 should be situated close to the vibrator assembly 10. On the other hand, it should not be placed where it will obstruct handling of the poker by the operator.

The hose 2 should be as flexible as possible without giving up the requirement of handling ease.

Tests have shown that on a hose 2 of ordinary flexibility, the extra weight 3 can be situated comparatively close to the vibrator casing 7 and still bring about appreciable damping of the vibration in that part of the hose 2 held by the operator.

On poker vibrators driven by a flexible shaft from a drive unit located outside the poker, the "hose" or shaft sheathing is necessarily very stiff. This necessitates positioning the extra weight 3 differently in relation to the poker as compared with poker vibrators having other types of power units, such as pneumatic vibrators or vibrators with an electric motor built into the poker casing.

Figure 4:
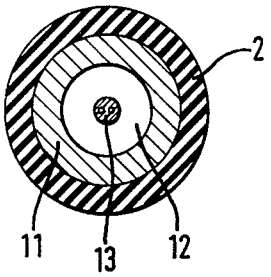

Another embodiment of the invention is shown in FIG. 4 wherein the extra weight 11 is made of metal and is mounted inside the hose 2. The weight 11 is configured as an annular member so as to provide a passage 12 for energy transmitting means such as electrical leads 13 for a poker vibrator wherein the eccentric weight means includes an electric motor.

It is understood that the foregoing description is that of the preferred embodiments of the invention and that various changes and modifications may be made thereto without departing from the spirit and scope of the invention as defined in the appended claims.

I claim:

1. A poker vibrator for imparting vibrations to an elastic material such as freshly poured concrete or the like, comprising:

a casing immersible in the elastic material and defining the outermost end of the vibrator;

eccentric weight means mounted in said casing for imparting vibratory motion to the latter and thereby to the elastic material;

a hose connected to said casing for transmitting energy to said eccentric weight means for actuating the latter;

said hose having a predetermined holding region thereon whereat said hose is held by an operator during the operation of the vibrator, said holding region being located at a given distance from said casing; and, a damping weight atached to said hose between said predetermined holding region and said casing for damping the vibrations transmitted along and by said hose to the operator holding said hose at said holding region during said operation.

2. The poker vibrator of claim 1, wherein said hose has an outer surface and said damping weight is fixedly attached to said hose at said outer surface.

3. The poker vibrator of claim 1, said hose having an inner surface defining the hollow interior thereof; and, said damping weight being mounted on said inner surface of said hose.

4. The poker vibrator of claim 3, said damping weight being an annular member defining a central passageway.

5. A poker vibrator for imparting vibrations to an elastic material such as freshly poured concrete or the like, comprising:

a casing immersible in the elastic material and defining the outermost end of the vibrator;

eccentric weight means mounted in said casing for imparting vibratory motion to the latter and thereby to the elastic material;

flexible conduit means connected to said casing;

energy transmitting means arranged in said conduit means for transmitting energy to said eccentric weight means for actuating the latter;

said flexible conduit means having a predetermined holding region thereon whereat said flexible conduit means is held by an operator during the operation of the vibrator, said holding region being located at a given distance from said casing; and, damping weight means attached to said flexible conduit means between said predetermined holding region and said casing so as to be spaced from said casing for damping the vibrations transmitted along and by said flexible conduit means to the operator holding said flexible conduit means at said holding region during said operation.

* * * * *